United States Patent [19]

Jacobson et al.

[11] Patent Number: 4,515,273

[45] Date of Patent: May 7, 1985

[54] BAG WITH TAB AND METHOD OF FORMING

[75] Inventors: Roger K. Jacobson, Ramsey; Ronald W. Munson, Minneapolis, both of Minn.

[73] Assignee: Bemis Company, Inc., Minneapolis, Minn.

[21] Appl. No.: 480,573

[22] Filed: Mar. 30, 1983

[51] Int. Cl.[3] ..... B65D 33/00

[52] U.S. Cl. ..... 206/604; 206/628; 383/88; 493/212; 493/927; 493/963

[58] Field of Search ..... 383/83, 82, 123, 78, 383/88, 89, 90; 206/610, 628, 632, 633, 605, 608, 604; 229/17 G, 17 R; 493/212, 213, 927, 963

[56] References Cited

U.S. PATENT DOCUMENTS

| | | | |
|---|---|---|---|
| 847,353 | 3/1907 | Merkels | 383/90 X |
| 1,987,596 | 1/1935 | Cox | 229/87 |
| 2,041,375 | 5/1936 | Schmerler | 229/1.5 |
| 2,100,141 | 11/1937 | Jackson | 206/609 |
| 2,121,443 | 6/1938 | Olsson | 229/51 |
| 2,262,111 | 11/1941 | Moore | 229/55 |
| 2,263,821 | 11/1941 | Williams | 229/51 |
| 2,475,236 | 7/1949 | Gollub | 229/62 |
| 3,074,610 | 1/1963 | Pugh | 229/7 |
| 3,193,180 | 7/1965 | Lissner | 229/62.5 |
| 3,446,420 | 5/1969 | Rinecker | 229/62 |
| 3,565,328 | 2/1971 | Hudson | 229/55 |
| 3,687,355 | 8/1972 | Goodrich et al. | 229/55 |
| 3,776,451 | 12/1973 | Goodrich et al. | 229/55 |
| 3,850,366 | 11/1974 | Saito | 229/55 |
| 4,069,964 | 1/1978 | Willet et al. | 229/62.5 |
| 4,260,061 | 4/1981 | Jacobs | 206/626 |

*Primary Examiner*—Stephen P. Garbe
*Assistant Examiner*—Bryon Gehman
*Attorney, Agent, or Firm*—Senniger, Powers, Leavitt and Roedel

[57] ABSTRACT

A pinch bottom open mouth ("PBOM") bag having a pinch bottom flap folded over upon and adhered to one wall of the bag, with a tab for tearing the flap open inserted at its inner end between the walls of the bag, folded to overlie the flap and the outside of the other wall and releasably adhered to the other wall, and a method of and apparatus for manufacturing the bags with the tabs from bag tubes wherein the tubes are continuously fed forward, one after another, tabs are applied to the tubes as the tubes travel forward and folded to overlie said other wall before the pinch closure flap is folded over, and wherein each tab is inserted between the walls of a tube by bringing the tab into a position overlapping said one wall and separating said one wall from the other to the point where the end of the tab slips off said one wall and becomes disposed between the walls.

13 Claims, 29 Drawing Figures

BAG WITH TAB AND METHOD OF FORMING

BACKGROUND OF THE INVENTION

This invention relates to bags, more particularly to a pinch closure bag with a tab for opening it, and a method of manufacturing bags with the tabs.

The invention relates especially to gusseted multiwall pinch bottom ("PBOM") bags with an easy-open tab feature, involving an improvement on bags of the type shown in copending coassigned U.S. patent application Ser. No. 406,213 of Richard W. Jacobs, filed Aug. 9, 1982, issued as U.S. Pat. No. 4,480,752 on Nov. 6, 1984, having a tab in a pinch closure at one end of the bag adapted to be grasped and pulled to open the bag, and to a method of manufacturing the bags with the tabs.

SUMMARY OF THE INVENTION

Among the several objects of the invention may be noted the provision of a bag, and more particularly a bag with a pinch closure, especially a pinch bottom open mouth ("PBOM") bag with an improved tab feature for tearing the bag open at the closure; the provision of such a bag with a tab so disposed that, as regards the filled and sealed bag, the tab neatly conforms to the closure to avoid having the tab torn off in the handling and shipping of the filled bag; and the provision of a method of efficiently mass producing bags with the tabs.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
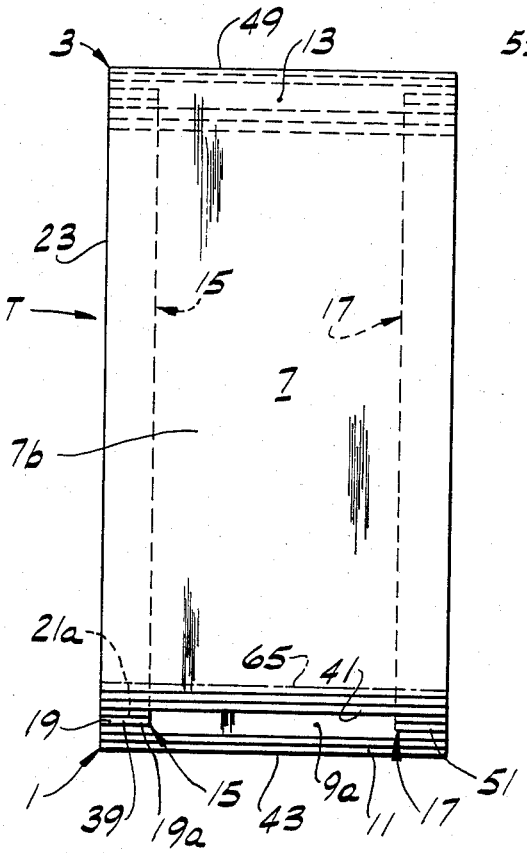
FIG. 1 is a view in elevation of one face of a gusseted multiwall paper bag tube having its ends formed for formation of a bag with pinch closures and incorporation in one of the closures (the closure at the end toward the bottom of the sheet of drawings as illustrated) of a tab in accordance with this invention for easy, clean opening of the bag as ultimately completed and filled.
Figure 2:
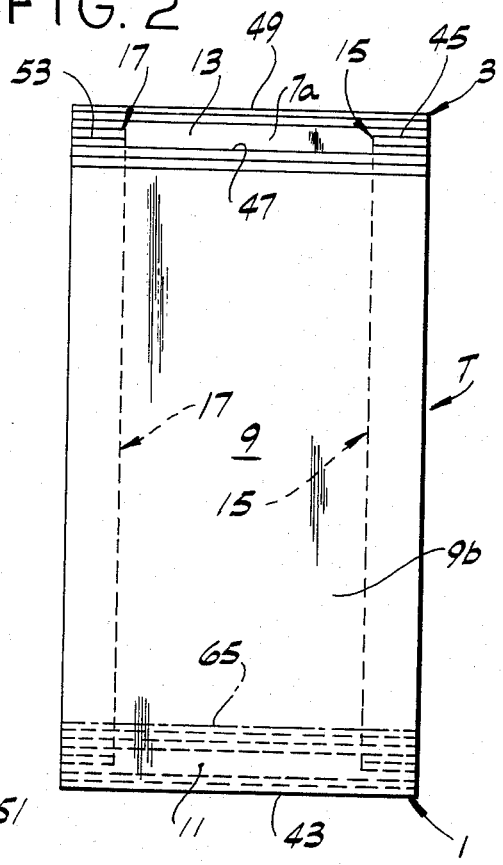
FIG. 2 is a view in elevation of the other face of the FIG. 1 bag tube.
Figure 6:
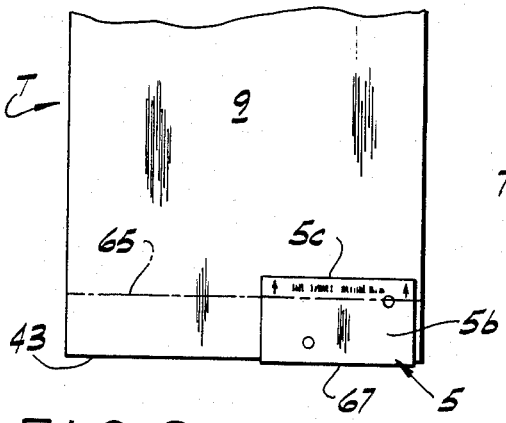
FIG. 6 is a view of the opposite face of the tube from FIG. 5, showing the tab so folded over and adhered thereto.
Figure 7:
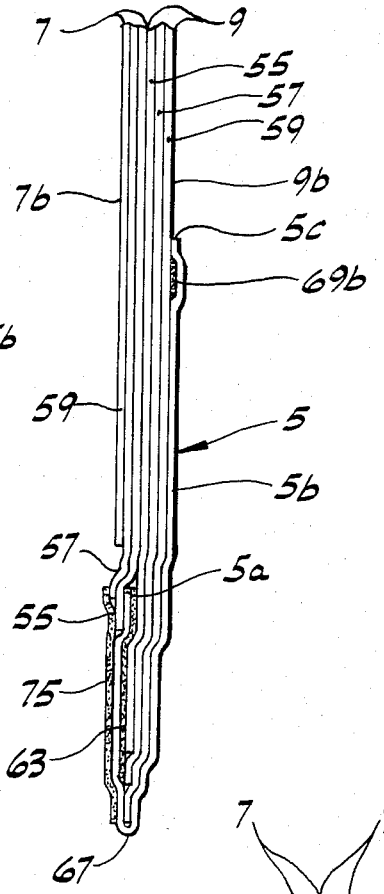
FIG. 7 is an enlarged section on line 7—7 of FIG. 5, with thicknesses exaggerated.
Figure 8:
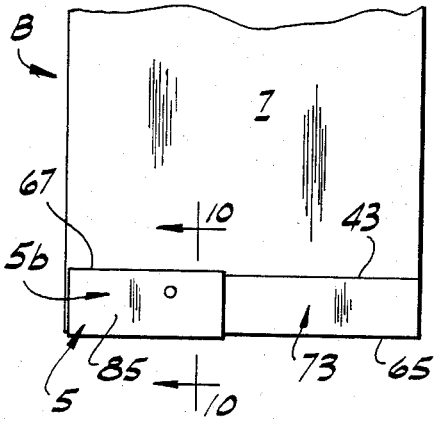
FIG. 8 is a view in elevation of that face of the bag illustrated in FIG. 3 showing the bag with the closure completed at the tab or factory end.
Figure 9:
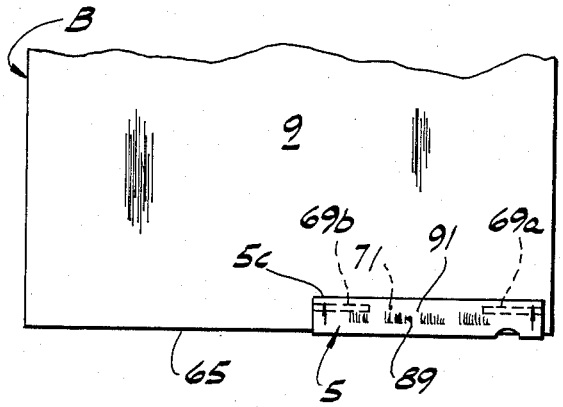
FIG. 9 is a view in elevation of the other face of the bag showing the bag with the completed closure and tab.
Figure 10:
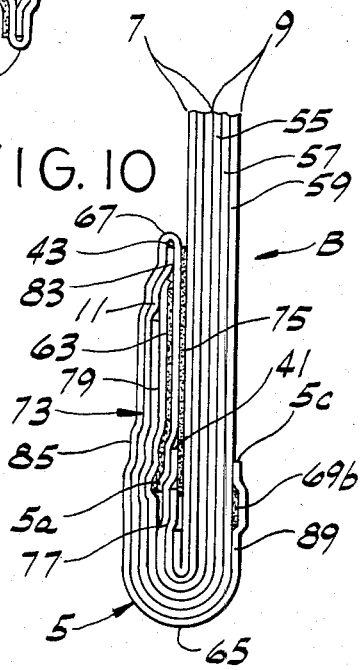
FIG. 10 is an enlarged section on line 10—10 of FIG. 8.
Figure 11:
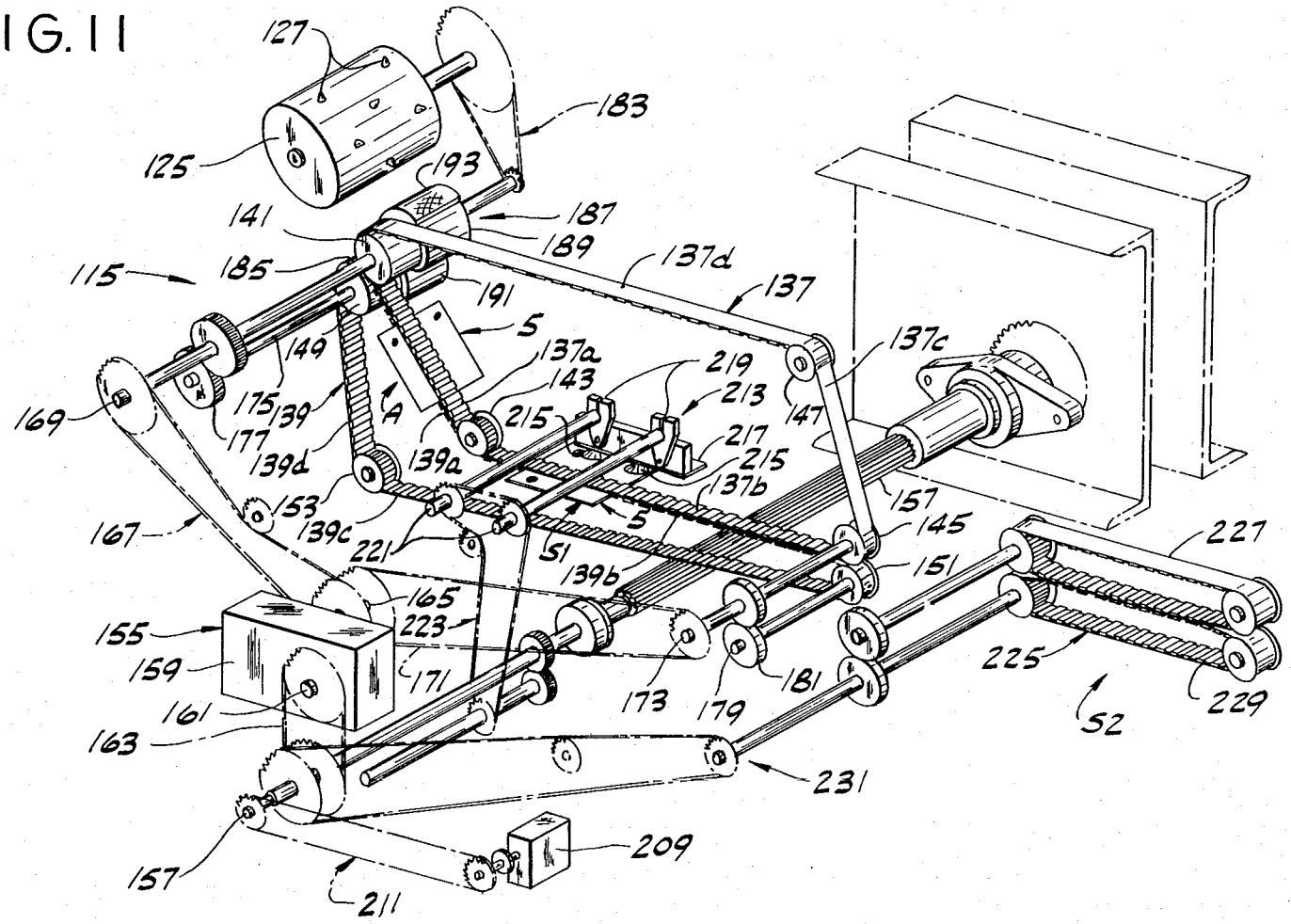
FIG. 11 is a perspective of part of the apparatus of this invention, more particularly that part of the apparatus where tabs are applied to bag tubes.

Referring to the drawings, FIGS. 1–4 illustrate a gusseted bag tube generally designated T having its ends, which are indicated at 1 and 3, formed for formation of pinch closures and incorporation in one of the closures (the lower closure, as the views are arranged on the sheets of drawings) of a tab 5 as shown in FIGS. 3–8 for easy clean opening of the bag as ultimately completed and filled. The bag completed with a pinch closure is shown in FIGS. 8–10, designated B. One wall of the tube T (and the bag B) is designated 7 and the other 9. Wall 7 may be referred to as the first or front wall, and wall 9 as the second or back wall. Wall 7 has inside and outside faces *7a* and *7b* and wall 9 has inside and outside faces 9*a* and 9*b*. The second or back wall 9 has an extension 11 at one end (its lower end 1 as illustrated in FIG. 1) beyond the respective end edge of the first or front wall 7, the latter having a corresponding extension 13 at the other end (the upper end 3 as illustrated in FIG. 1) beyond the wall 9.

The gussets of the bag are generally indicated at 15 and 17. Gusset 15 (which is at the left in FIGS. 1 and 3–6) has what may be termed a first or front half 19 and a second or back half 21, the front half 19 being joined to the front wall 7 at a fold line 23, the two halves 19 and 21 being joined at a fold line 25 (the center fold of the gusset), and the back half being joined to the back wall 9 at a fold line 27. Similarly, gusset 17 (at the right in FIGS. 1 and 3–6) has what may be termed a front half 29 and a back half 31, the front half being joined to the front wall 7 at a fold line 33, the two halves 29 and 31 being joined at a fold line 35 (the center fold of the gusset), and the back half being joined to the back wall 9 at a fold line 37.

Gusset 15 has a lower end portion generally indicated at 39 extending beyond the lower end edge 41 of wall 7 at the lower end 1 of the bag tube T and terminating short of the lower end edge 43 of extension 11 of the back wall 9, and a corresponding upper end portion generally indicated at 45 extending beyond the upper end edge 47 of wall 9 at the upper end of the bag tube and terminating short of the upper end edge 49 of extension 13 of the front wall. Similarly, gusset 17 has a lower end portion generally indicated at 51 extending beyond the lower end edge 41 of wall 7 at the lower end 1 of the bag tube and terminating short of the lower edge 43 of extension 11 of the back wall 9, and a corresponding upper end portion generally indicated at 53 extending beyond the upper end edge 47 of wall 9 at the upper end of the bag tube and terminating short of the upper end edge 49 of extension 13 of the front wall 7. As shown, the front and back halves of both gussets are stepped at their ends in a conventional manner. While not so shown in the drawings so as not to obscure detail, wall 7 may be formed with an extension or tongue of the inner ply 55 (corresponding to that indicated at 61 in the aforesaid copending application Ser. No. 406,213) covering the end portion 39 of gusset 15 at the lower left corner of the bag tube as illustrated in FIGS. 1, 3, 4 and 5.

Figure 3:
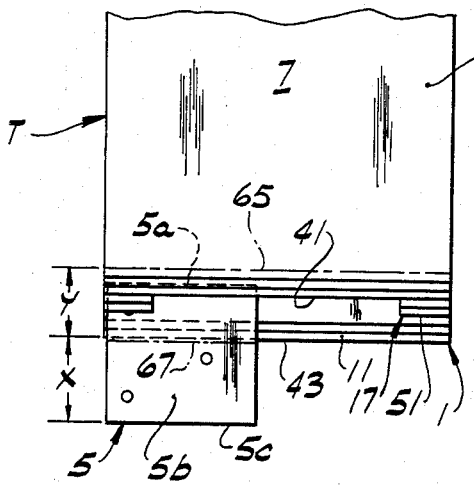
FIG. 3 is a fragment of FIG. 1 showing said one end (which may be referred to as the tab or "factory" end) of the tube with a tab inserted.
Figure 4:
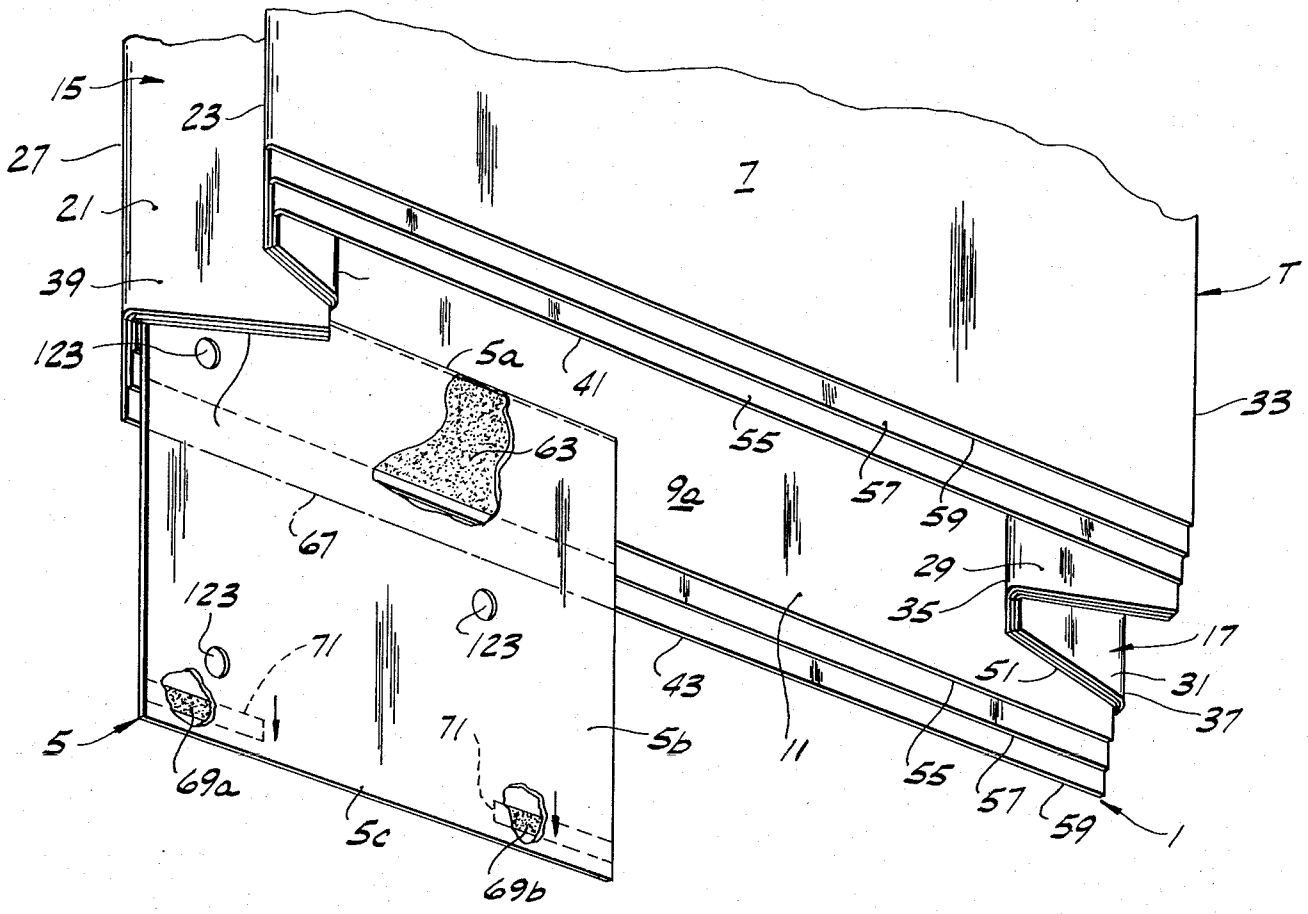
FIG. 4 (sheet 2) is a perspective showing the tab or factory end of the bag tube opened up (i.e., with the bag walls spread apart) and the tab inserted as in FIG. 3, on a larger scale than FIGS. 1 and 3.

As illustrated, the tube T (and hence bag B) is a multiwall (i.e., multiple ply) tube, shown as having three plies: an inner ply 55, an intermediate ply 57 and an outer ply 59 (see FIG. 4). Within the scope of the invention, the bag may be a single-ply bag or have various numbers of plies. All the plies may be paper, or the bag may have a plastic ply. The plies preferably are stepped at the lower margin of extension 11 and at the upper margin of extension 13, as appears in FIGS. 1–5, such stepping being generally conventional and well known in the art (see, for example, U.S. Pat. No. 3,687,356). As herein illustrated, the plies are not stepped at the ends of the gusset halves, although they could optionally be stepped at the ends of the gusset halves in a conventional and well known manner.

Tab 5, which may comprise a rectangular piece of relatively stiff, strong heavy paper or paperboard, is inserted in the lower end of the bag tube T at the left side of the bag tube as viewed in FIGS. 3 and 4 so that its inner end margin at 5*a* is disposed between the back half 21 of the left-hand gusset 15 and the back wall 9 (including extension 11) of the tube. The tab is of such width as to enable it to be firmly grasped between the thumb and fingers of the hand for the ultimate pulling of the tab to tear open the bag as ultimately completed, filled and sealed (as will appear), and of such height as to extend well beyond the lower end edge 43 of the back wall 9 of the bag tube. Typically, the tab is about six inches wide. Its height will vary depending on the size of the bag tube, a typical height being about four and one-half inches. It is inserted in the open lower end of the bag tube T with its left edge 5*t* at the fold 27 where the back half 21 of the gusset 15 joins the back wall 9, and is adhesively secured (as by means of hot-melt glue, for example) to the back wall of the bag (i.e., to the front face of extension 11 of the back wall) as indicated at 63. The tab is inserted in the stated open lower end of the bag tube T at least to the point where its inner edge 5*a* is somewhat inward of (above, as illustrated in FIG. 3) the lower end edge 41 of the first or front wall 7 of the bag tube. And it is preferably inserted to the point where its inner end edge 5*a* is somewhat (e.g., ⅜ inch) inward of (above, as illustrated in FIG. 3) on the lower end edge 41 of wall 7 of the bag tube, but not as far in as the line indicated at 65 on which a lower end portion of the tube is subsequently folded over on wall 7 to form a closure flap, as will appear.

In accordance with this invention, the height of the tab 5 is such that with the inner end portion of the tab indicated at 5*a* in FIGS. 3–5, 7 and 10 inserted as described between the walls 7 and 9 of the bag tube T, the tab has an outer part indicated in its entirety at 5*b* extending out beyond the end edge 43 of extension 11 of the back wall 9 a distance as indicated at X greater than the spacing indicated at Y of the fold line 65 from edge 43 of extension 11 (see FIG. 3). The stated outer part 5*b* of the tab is folded over on a fold line indicated at 67 adjacent end edge 43 of extension 11 to overlie the outside face of the back wall 9 of the tube and releasably adhered to the outside face of wall 9 with the outer end 5*c* of the tab adapted to be grasped and pulled away from the wall 9. This adherence of the outer part 5*b* of the tab to the outside face of wall 9, as illustrated, is by means of a two aligned narrow stripes or beads 69*a* and 69*b* of hot melt adhesive extending transversely of the tab adjacent its outer end edge at 5*c*, with a gap indicated at 71 between the inner ends of these stripes or beads 69*a* and 69*b* for insertion of the thumb for grasping and pulling the tab. The stripes or beads of adhesive 69*a* and 69*b* are applied to the tab along with the adhesive at 63 which adheres the tab to the back wall 9 of the tube T on what is in effect the inside face of extension 11 before the tab is applied to the tube, the adhesive at 63 being applied in a relatively wide stripe, all as will appear.

Figure 5:
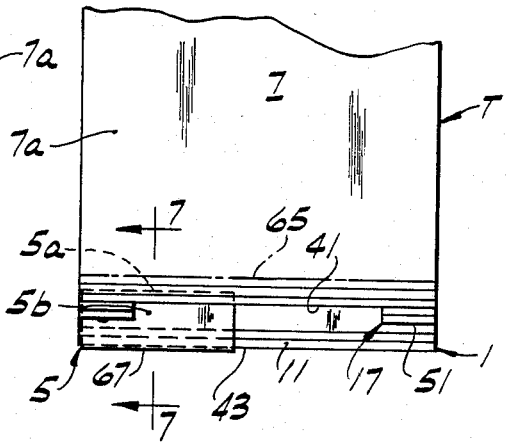
FIG. 5 (sheet 1) is a view illustrating a step in the manufacture of the bag with the tab wherein, after the tab is inserted in the bag tube as in FIGS. 3 and 4, the tab is folded over around the end edge of the wall of the tube which underlies the tab and adhered to the outside face of that wall.

The tab end 1 of the bag tube T, having the tab 5 inserted therein and folded on line 67 as above described, is formed with a pinch closure (a "pinch bottom" for the bag) indicated by the reference numeral 73. This closure comprises a flap folded over on the stated fold line 65, which extends transversely across the bag tube spaced inwardly from (i.e., above as shown in FIGS. 1, 3 and 5) the lower end edge 41 of the first or front wall 7, the flap being folded to overlie the wall 7 on its outside and being adhered by adhesive, such as a hot melt glue, as indicated at 75 in FIG. 10 to the wall 7. With the fold line 65 spaced inwardly from the end edge 41 of the wall 7, the closure or flap 73 comprises an end portion 77 of the wall 7 from fold line 65 to edge 41, a portion 79 of the other wall 9 coextensive with portion 77, and the extension 11 of wall 9. The tab 5 is folded on line 65 along with the flap 73 and, in the completed pinch closure, has an inner end portion as indicated at 5*a* in FIG. 10 between portions 77 and 79 of the walls 7 and 9, an intermediate portion 83 underneath the extension 11, and portion 5*b* projecting out from under the extension 11. Portion 77 of wall 7 and the extension 11 are adhered by the adhesive at 75 to the outside face of wall 7. Portion 83 of the tab underneath the extension 11 is adhered by adhesive at 75 along with the flap 73 to the outside face of wall 7. The stated outer portion 5*b* of the tab, which extends out from under the flap 73, which has been given special treatment in accordance with this invention as above described, is characterized in that it has a first part 85 folded over on fold line 67 adjacent the end edge 43 of wall 9 of the bag at the tab end of the bag and overlying the flap 73, and a second part 89 folded over on a fold line generally coincident with the flap fold line 65 and overlying wall 9 of the bag. This second part 89 of the flap is releasably adhered by the adhesive indicated at 69*a, b* to wall 9 and has a free portion indicated at 91 at the gap 71 for enabling the tab to be grasped and pulled to tear the bag open. The stated first part 85 of the tab is unadhered to and free of the flap 73.

Generally, the bag is supplied by the bag manufacturer to the bag packer with the pinch closure 73 made at the end 1 of the bag and constituting a pinch bottom for the bag, with the tab 5 incorporated in the pinch closure or pinch bottom 73, and with the bag open at its other end 3 for filling, i.e., the bag is a pinch bottom open mouth ("PBOM") bag. After the bag is filled, it is closed by means of a pinch closure in conventional manner at its mouth end 3. To open the bag, the tab 5 is grasped at 91, pulled to release it from the wall 9, and pulled in the direction away from the bag (generally down as viewed in FIGS. 8 and 10), resulting in tearing of the closure or flap 73 and thereby providing an opening for pouring out the bag contents at the tab corner.

Figures 12, 13, 14:
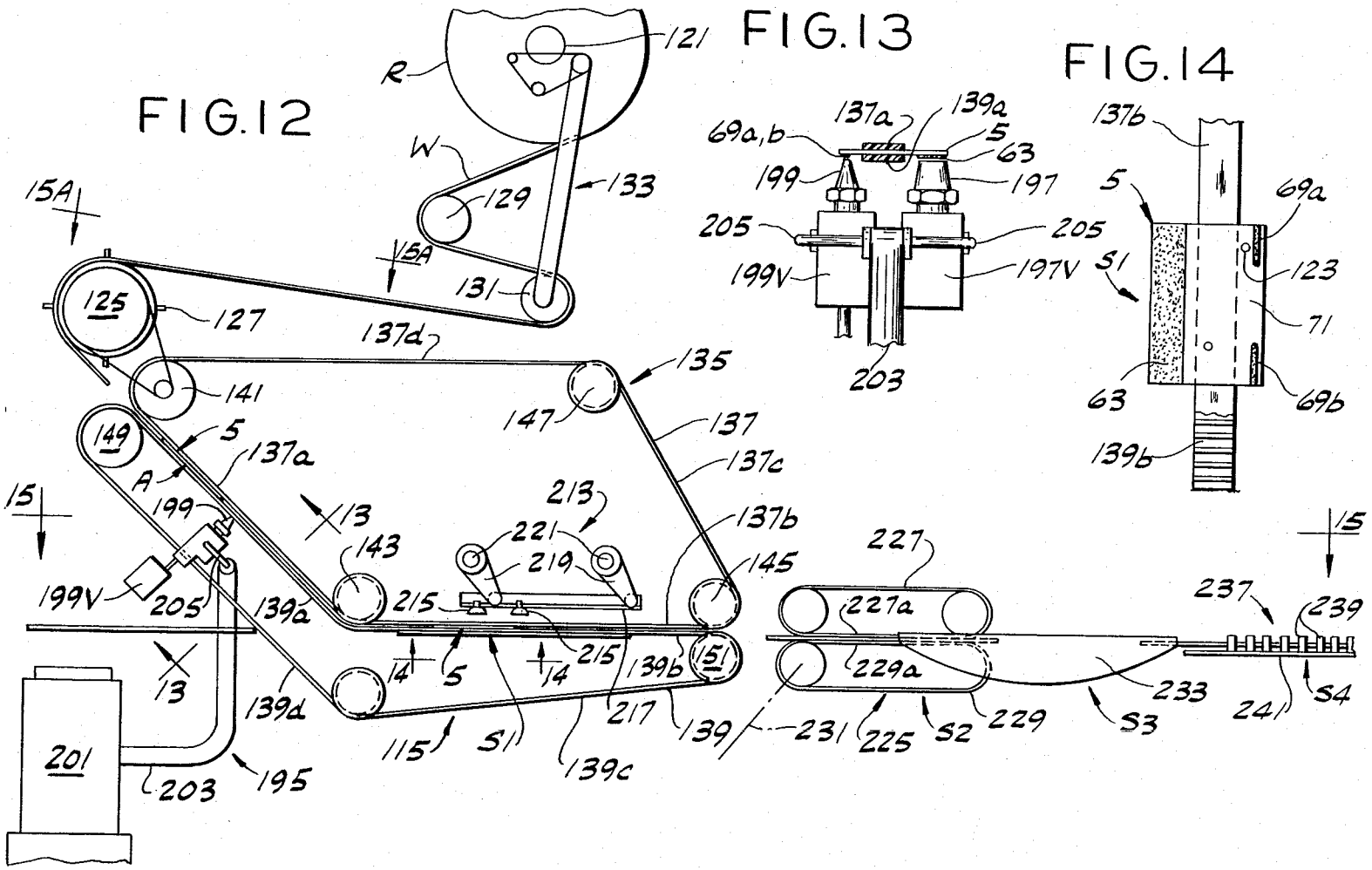
FIG. 12 is a view in side elevation of the FIG. 11 part of the apparatus, and adding certain components of the apparatus.
FIG. 13 is a section generally on line 13—13 of FIG. 12, showing an applicator for applying adhesive to the tabs prior to their application to the bag tubes.
FIG. 14 is a view generally on line 14—14 of FIG. 12 looking up at the bottom of a tab with adhesive applied thereto and gripped between tab feed belts of the apparatus.
Figure 15:
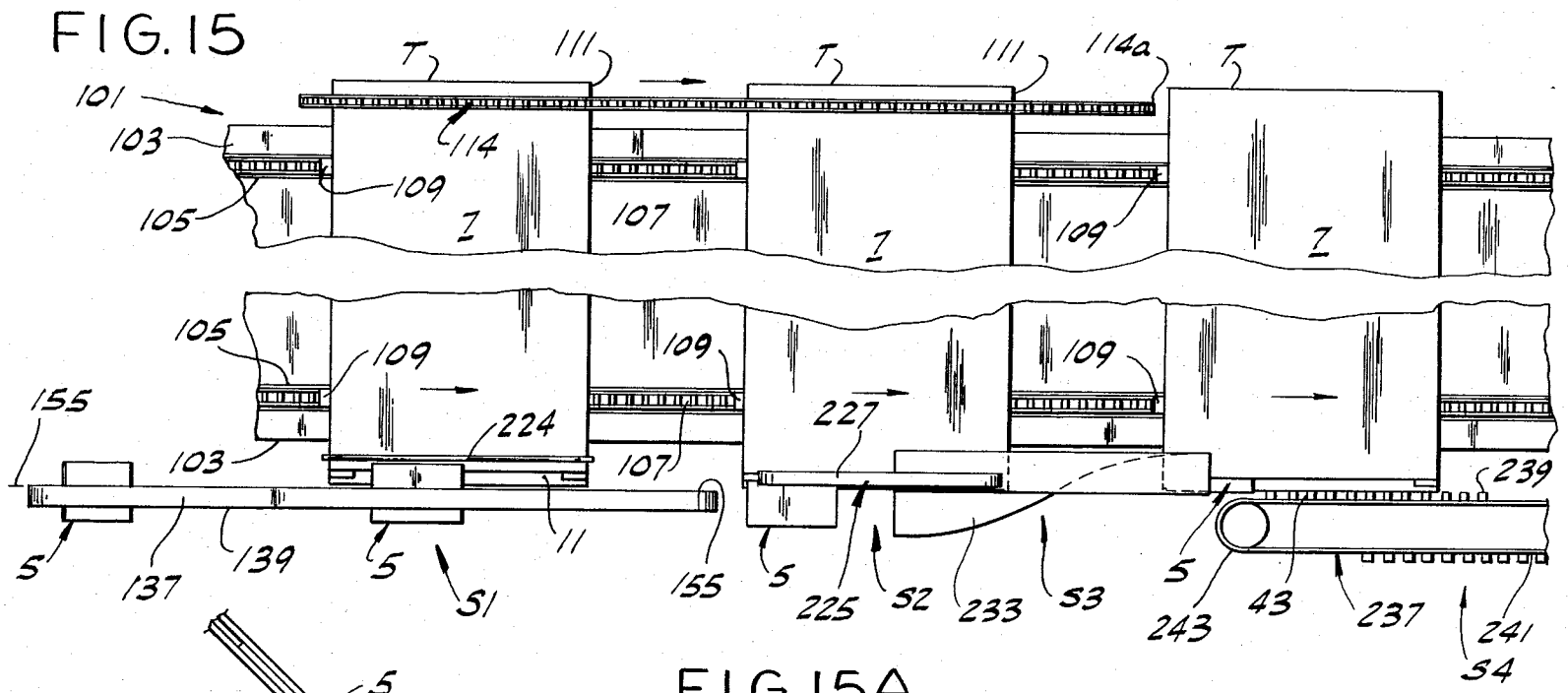
FIG. 15 is a view generally in plan on line 15—15 of FIG. 12.
Figure 26:
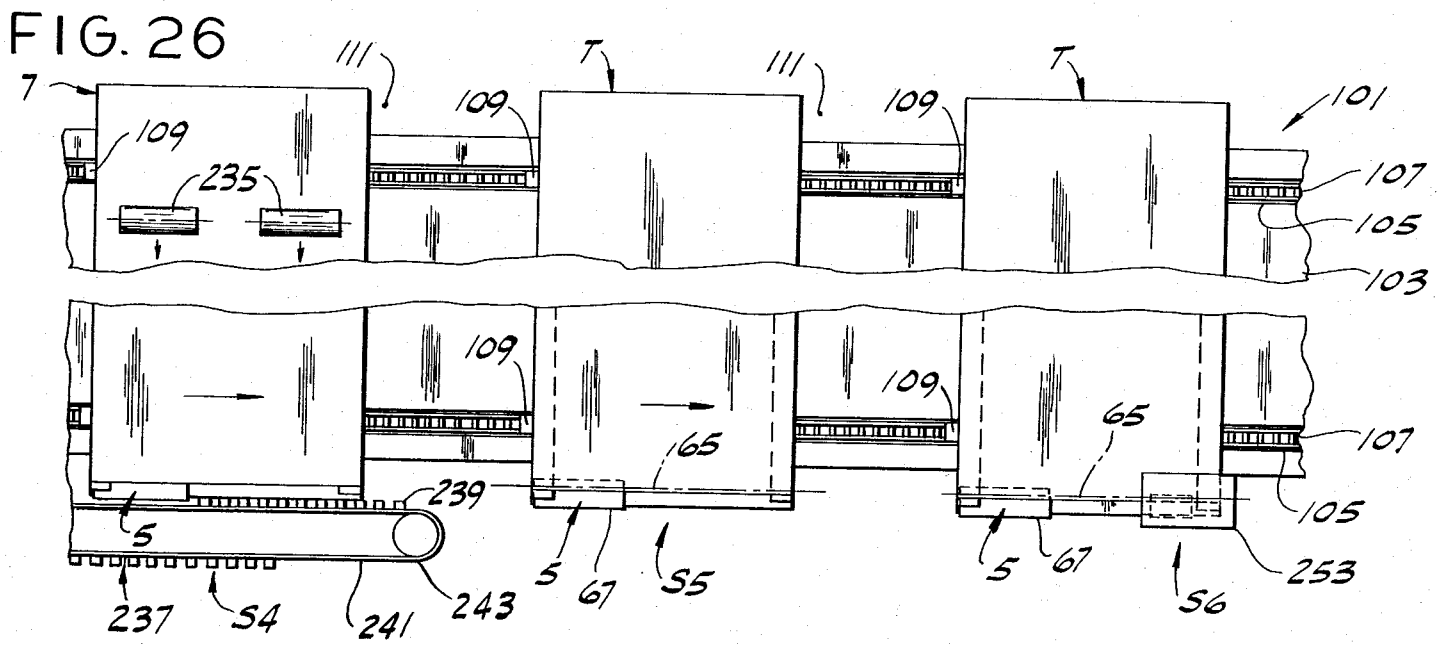
FIG. 26 is a continuation of FIG. 15 and a plan of FIG. 25.
Figure 25:
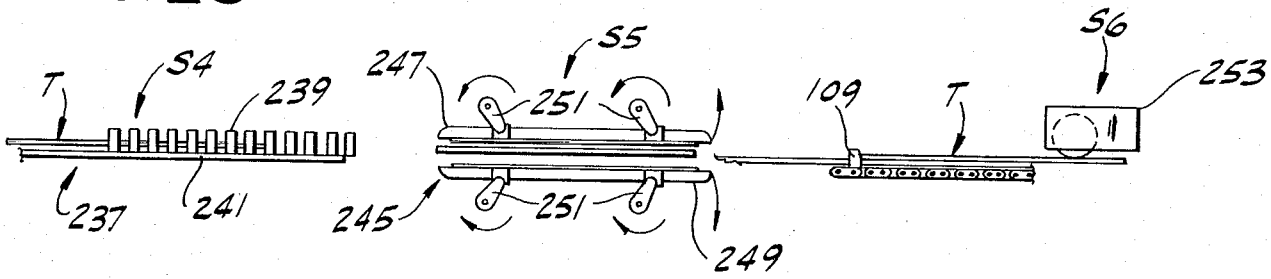
FIG. 25 is a continuation of FIG. 12.
Figure 28:
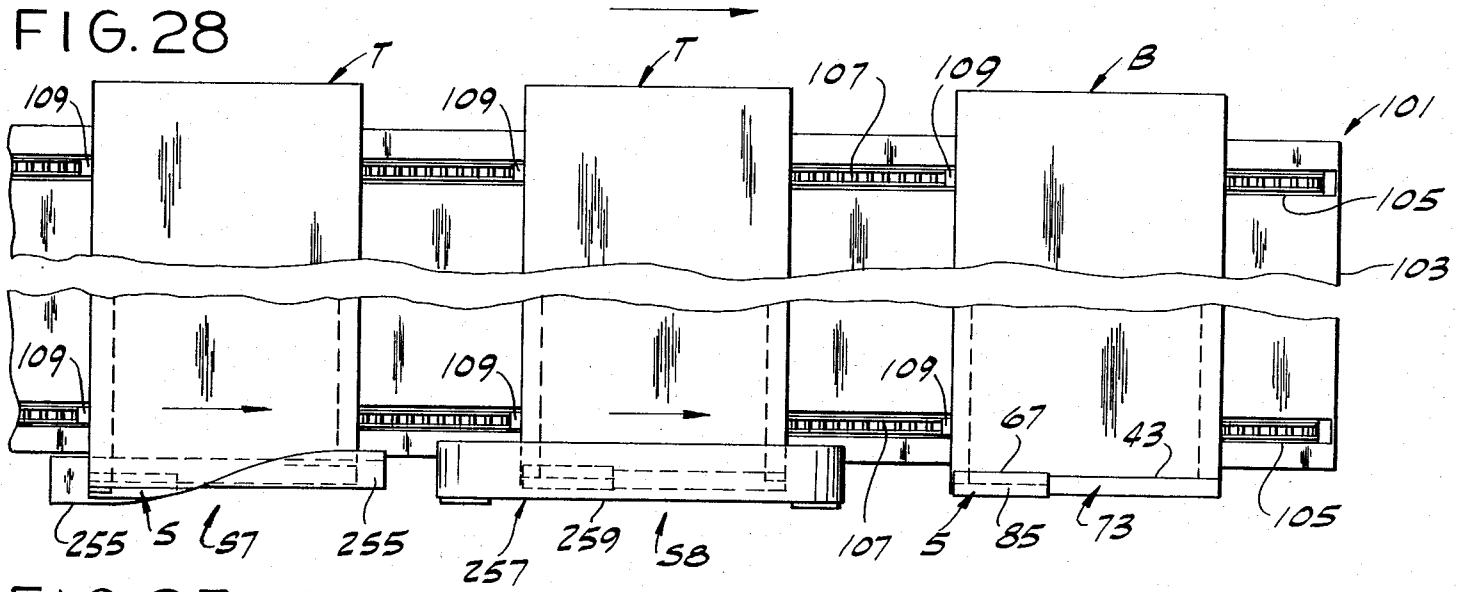
FIG. 28 is a continuation of FIG. 26 and a plan of FIG. 27.
Figure 27:
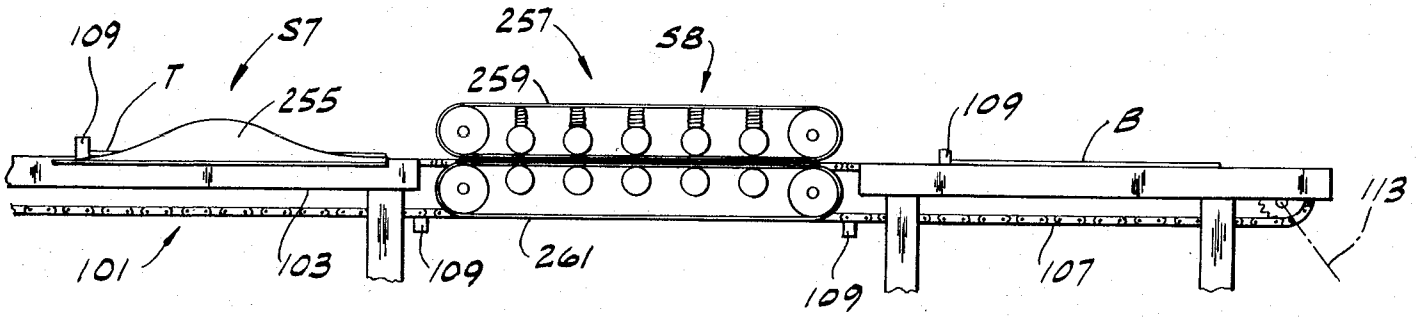
FIG. 27 is a continuation of FIG. 25.

The method of and apparatus for manufacturing bags with the tabs as above described are illustrated in FIGS. 11–28. As shown in FIGS. 15, 26 and 28, means indicated generally at 101 is provided for feeding bag tubes T forward one after another in a generally horizontal path of travel with the tubes generally horizontal and extending transversely with respect to said path of travel. This means may comprise, for example, the bag tube feeding conveyor of what is referred to in the art of bag manufacture as a bottomer for forming one end (the "factory end") of each bag tube with a pinch closure (i.e., a "pinch bottom") by folding over and adhering down the flap such as indicated at 73. This bag tube feeding means or conveyor, as illustrated, is of a type well known in the art comprising a table 103 along which the tubes T slide, having a pair of slots 105 and a pair of endless chains 107 having feed dogs or lugs 109 which, in the upper reach of the chains, extend up through the slots 105 for pushing tubes T forward along the table. The lugs 109 are spaced along the chains at intervals greater than the tube width, so that there are spaces as indicated at 111 between successive tubes being fed forward by the lugs. The conveyor chains 107 are driven at a predetermined speed by drive means indicated diagrammatically at 113 (FIG. 27) continuously to feed the tubes forward one after another at a predetermined speed through a series of stations, with the end 1 of each tube where a tab is to be applied projecting beyond the respective edge of the table (its right-hand edge as viewed looking downstream with respect to the conveyor means). The tubes T lie flat on the table with wall 7 up and wall 9 down. At the left of the table 103 (left as viewed looking downstream) is a so-called field end holding conveyor 114 comprising an upper and a lower endless chain driven along with chains 114 which grip the end 3 (the "field" end) of the tubes and hold the tubes in a laterally registered position as they slide forward on table 103.

Figure 15A:
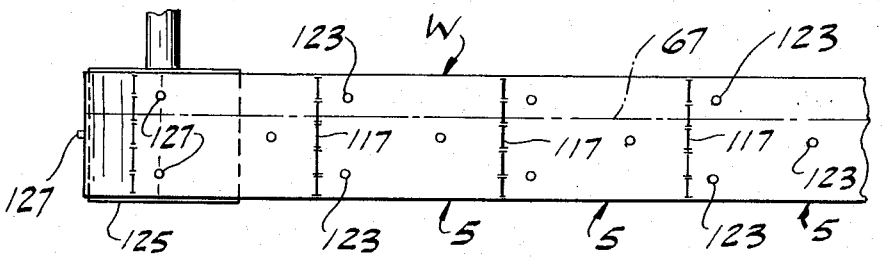
FIG. 15A is a view generally in plan on line 15A—15A of FIG. 12.
Figure 16:
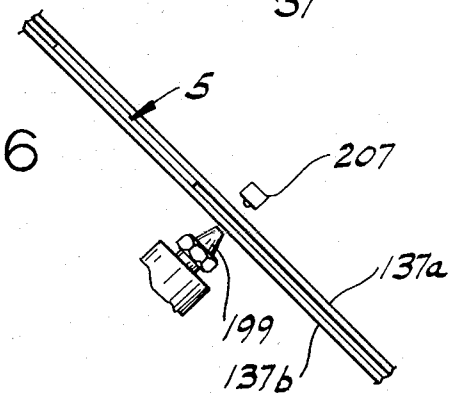
FIG. 16 is an enlarged fragment of FIG. 12.

Means indicated generally at 115 is provided for feeding tabs 5 forward one after another and bringing each tab to a dwell position at a first station S1 along the path of travel of the bag tubes 1 wherein the tab is located at the tab end 1 of a tube T being fed forward by the tube conveyor means 101, with the inner end margin of the tab at 5*a* overlapping wall 7 of the tube (which is its uppermost wall as the tubes lie on the table 103), and with the tab extending endwise of the tube and having its outer part 5*c* extending out beyond the end edge 43 of extension 11 of the tube T at said tab or "factory end" 1 of the tube. As illustrated, and by way of example, tabs 5 are supplied as a continuous web W of tab stock (paper or paperboard) having a width corresponding to the desired length for the tabs (e.g., four and one-half inches) and formed with lines of weakness, e.g., lines of perforations, as indicated at 117 in FIG. 15A for snapping apart of the web on the lines of weakness to separate individual tabs from the web, these lines being spaced at intervals corresponding to the desired width for the tabs (e.g., six inches). The web of tab stock is preferably scored on a line designated 67 extending longitudinally of the web providing a score line extending widthwise of each tab for the folding of each tab on the line 67 as indicated in FIGS. 4, 6 and 7. The continuous web or series of tabs is wound into a roll R as shown in FIG. 12, and this roll is mounted for unwinding on an arbor indicated at 121 in FIG. 12 as the tab supply for the tab feeding means 115. The continuous web or series of tabs has holes 123 therein which function, in effect, as sprocket holes for the timed unwinding of the web from the supply roll R. Unwinding is by means of a timing drum 125 having sprocket pins 127 spaced on its periphery for entry in the sprocket holes in the web passing around the drum. The web W, unwinding from the supply roll R, is trained around a guide roll 129, thence around an idler roll 131 of a conventional brake means 133 for maintaining a generally constant tension on the web between the supply roll and the timing drum, and thence around the drum. The web, coming off the drum, is directed into the entrance end of a tab conveyor means 135 comprising an upper timing belt 137 and a lower timing belt 139. The upper belt travels in a generally parallelogrammatic path, being trained around rolls 141, 143, 145 and 147 to have a downwardly extending forwardly inclined first tab feeding reach 137*a* from roll 141 to roll 143, a lower generally horizontal second tab feeding reach 137*b* from roll 143 to roll 145, an upwardly extending and rearwardly inclined first or forward return reach 137*c* from roll 145 to roll 147, and a generally horizontally extending second upper or return reach 137*d* from roll 147 to roll 141. The lower belt 139 is trained around a roll 149 and roll 143 to have a downwardly extending forwardly inclined first tab feeding reach 139*a* mating with reach 137*a* of the upper belt 137, a horizontal second tab feeding reach 139*b* from roll 143 to a roll 151 underneath and mating with horizontal lower reach 137*b* of the upper belt, a lower somewhat downwardly inclined first return reach 139*c* from roll 151 to a roll 153, and an upwardly extending rearwardly inclined second return reach 139*d* from roll 153 to roll 149. The timing belts are narrow relative to the width of the web W, i.e., relative to the tab length, so that a tab 5 may be gripped by and between the belts more or less centrally of the tab as shown in FIGS. 14 and 15, with part of the tab projecting out from between the belts at one side of the belts and another part projecting out from between the belts at the other side of the belts. The rolls 141 etc. for the belts are located for travel of the belts in a vertical plane just outside of and parallel to the end edge 43 of wall 9 of each bag tube T being fed forward by the bag tube conveyor means 101, as appears in FIGS. 15 and 18 where the vertical plane of the edges of the tab feed belts toward the right-hand edge of table 103 (right-hand as viewed looking in downstream direction) of the tube conveyor means 103 is indicated at 155, the edge 43 of wall 9 of each bag tube T being fed forward by the tube conveyor means is shown as just outside this plane (at its left as viewed in FIG. 18).

Rolls 141 and 145 for the upper timing belt 137 and rolls 149 and 151 for the lower timing belt 139 are adapted to be positively intermittently driven by drive means indicated generally at 155 (see FIG. 11) comprising a main drive shaft 157 continuously driven in synchronism with the tube feed conveyor means 101 and an indexing drive 159 having an input 161 continuously driven by shaft 157 via a chain and sprocket drive 163, and an intermittently driven output 165 connected by a chain and sprocket drive 167 to shaft 169 for roll 141 and by a chain and sprocket drive 171 to shaft 173 for roll 145. Shaft 169 is geared to drive shaft 175 for roll 149 via gearing 177 and shaft 173 is geared to drive shaft 179 for roll 151 via gearing 181. The timing drum 125 is driven from the shaft 169 by a chain and sprocket drive 183 and is adapted to feed the web W forward to the entrance nip at 185 of the belts 137 and 139, and also to feed the web to means indicated generally at 187 for snapping off the leading tab 5 from the web, i.e., for tearing the leading tab away on the line of weakness 117 between the leading tab and the next tab. This snap-off means comprises a pair of segmented snap-off rolls 189 and 191, one on shaft 169 next to the timing belt roll 141 and the other on shaft 175 next to the timing belt roll 149. These rolls have raised portions or segments such as indicated at 193 in FIG. 11 for roll 189. The drive for shaft 169 and drum 125 is such that the drum feeds one tab length of the web W forward to the belts 137 and 139 and the snap-off rolls 189 and 191 for each bag tube T fed forward by the bag tube conveyor 101, the snap-off rolls rotating one complete revolution for each tube T. As these rolls rotate through this single-revolution cycle, their raised portions 193 grip the leading tab 5 and snap it off. The web is fed into the nip 185 of the belts 137 and 139 and to the snap-off rolls 189 and 191 with the web extending laterally outward from the belts at both sides, and with that part of the web which extends to the left from the belts between the snap-off rolls so that the leading tab 5, snapped off from the web, is gripped between the belts and projects laterally outward from the belts at both sides of the belt as appears in FIGS. 11, 12, 14 and 18.

The indexing drive 159 is operable intermittently in cycles in timed relation to the feed of the bag tubes T by the bag tube conveyor 101, one cycle for each tube. In each cycle, the timing drum 125 is driven to feed one tab length (e.g., four and one-half inches) of web forward to the belts and the snap-off rolls. The belts are driven forward a distance corresponding to said tab length. As above described, the snap-off rolls are driven through a revolution and snap off the leading tab from the web. The raised segments 193 of the snap-off rolls are so phased that the snap-off of the tab is completed before the snap-off rolls and belts complete their movement in the cycle, and the belts feed the snapped-off tab 5 forward away from the rolls to a first dwell position indicated at A in FIGS. 11 and 12. Also, on each cycle, the tab that was in the dwell position at A is fed forward by the belts to the dwell position at station S1 in FIGS. 11 and 12 downstream from dwell position A the distance through which the belts travel on a cycle. Station S1 is referred to as the tab insertion station.

Means indicated generally at 195 in FIG. 12 is provided for applying adhesive to the tab 5 as it travels forward from its first dwell position A to its second dwell position at station S1. This means, as illustrated, is preferably a hot melt adhesive applicator, adapted to apply hot melt adhesive from a supply to the underside of a tab 5 on opposite sides of the tab feed belts 137, 139. Preferably, the applicator comprises two side-by-side nozzles 197 and 199 (see FIG. 13) for applying the hot melt adhesive in two streams extending from the leading to the trailing edge of the tab 5 as the tab is fed forward by the belts from the first dwell position A to station S1. Nozzle 197 has a relatively wide outlet for applying to the tab the relatively wide stripe 63 of adhesive for adhering the tab to the front (inside) face of extension 9. Nozzle 199 has a relatively narrow outlet for applying beads 69*a*, *b* for tacking down the outer end section of the tab as will appear. The nozzles are supplied with melted adhesive from a reservoir 201 via a main delivery pipe 203 and branch lines 205, each nozzle having a solenoid valve associated therewith, these solenoid valves being indicated at 197V and 199V in FIGS. 12 and 13. The solenoid valves are connected in a suitable circuit for energization to open them when the leading edge of a tab being fed forward from position A to station S1 passes a sensor means 207 (see FIG. 16, which may be a photocell sensor means). Valve 199V is also under control of an interrupt switch 209 driven as indicated at 211 in FIG. 11 off the main drive shaft 157 for interrupting delivery of adhesive by nozzle 199 to provide the gap 71 between beads 69*a* and 69*b* of adhesive.

Figure 17:
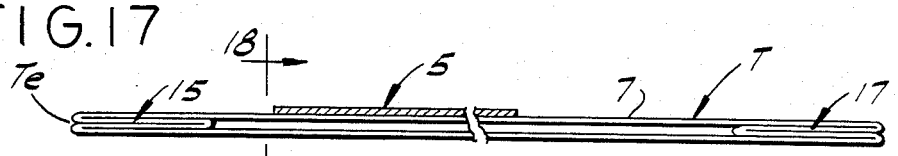
FIG. 17 is an enlarged fragment of FIG. 12 showing a tab as initially delivered to a bag tube which is being fed forward through the apparatus in the direction of the arrow shown in this figure.
Figure 19:
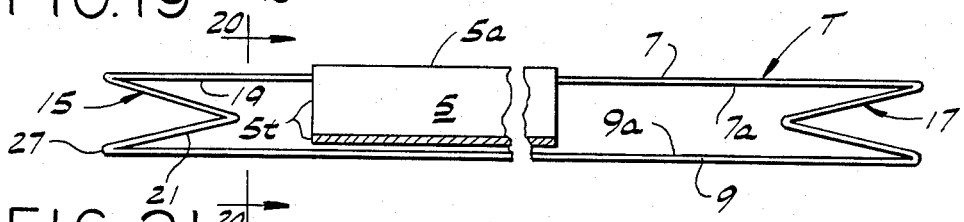
FIG. 19 is a view similar to FIG. 17 showing a step in the procedure involving opening up the bag tube for insertion of the tab.
Figure 21:
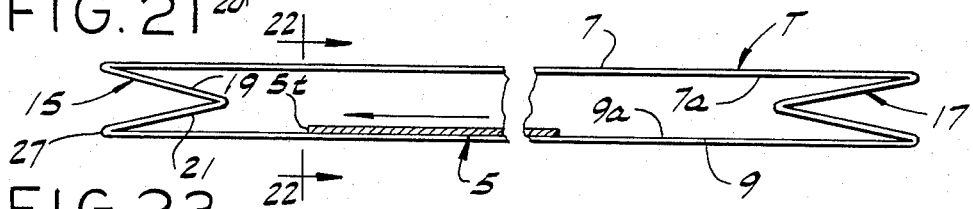
FIG. 21 is a view similar to FIG. 19 showing a further step involving the bending back (bending down) of the tab for its insertion.
Figure 18:
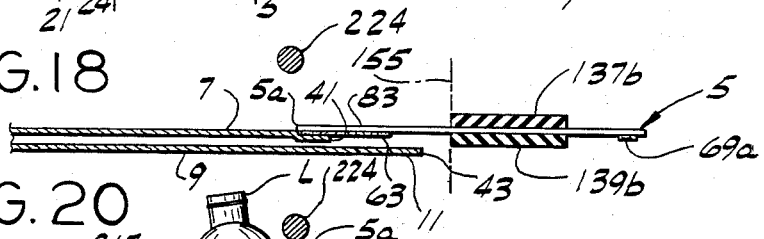
FIG. 18 is a view generally on line 18—18 of FIG. 17.
Figure 22:
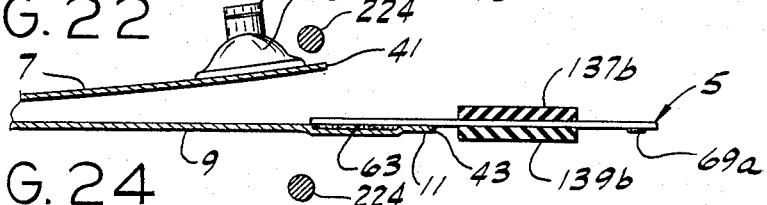
FIG. 22 is a view generally on line 22—22 of FIG. 21 showing the FIG. 21 bending down step.

The tab 5 which has been delivered by belts 137 and 139 to the dwell or insertion position at the tab insertion station S1, and which is held stationary in that position for a dwell interval, is located for the passage thereunder of the tab end 1 of a tube T being continuously fed forward by the tube conveyor 101 (see FIGS. 15, 17 and 18). The inner end margin of the tab at 5*a*, which is ultimately inserted in the tube, is so located as to overlap the first wall 7 (the uppermost wall) of a tube T, the tab extending endwise of the tube and having an intermediate portion (which becomes portion 83) overlying the extension 11 of the second wall 9 of the tube, and outer end part 5*b* projecting out beyond the end edge 43 of wall 9 at the tab end 1 of the tube. The tab end portion of the tube T including the extension 11 of wall 9 of the tube travels forward under the inner end margin at 5*a* and the stated intermediate portion of the tab and, as it does do, the first wall 7 (the uppermost wall) of the tube is separated (raised) from the second wall 9 (the lower wall) of the tube by means indicated generally at 213. This separation occurs while the outer end portion of the tab is held by the belts 137 and 139 against movement out of the plane of the tab, i.e., against being raised, so that the inner end portion of the tab at 5*a* bends outwardly (upwardly) out of the plane of the tab and away from the second wall 9 of the tube T (see FIGS. 19 and 20). The first wall 7 of the tube is separated from the second wall 9 to a point where the inner end margin of the tab at 5*a* slips off the first wall 7 and bends back down to become disposed (inserted) between the walls as illustrated in FIGS. 21 and 22. All this occurs as the tube T is travelling forward and the tab 5 is stationary at station S1. When the tab has bent back down between the tube walls (FIGS. 21 and 22), the belts 137 and 139 start feeding the tab forward at a speed slower than the speed of the tube T (being continuously fed forward at a speed which may be referred to as the tube or bottomer speed). As a result of the speed differential, the tube T moves forward relative to the tab 5 (or the tab moves rearward relative to the tube) to the point where the trailing edge 5*t* of the tab, i.e., its edge toward the trailing side edge Te of the tube engages the trailing side edge Te of the tube within the tube, thereby to bring the inserted tab to the trailing corner of the tube at the tab end 1 of the tube against said trailing side edge Te. More particularly, the separation (raising) of the first wall 7 of the tube from the second wall 9 causes the gusset 15 at the trailing side of the tube to expand as shown in FIGS. 19 and 21. When the inner end portion of the tab bends back down, the lower face of the tab engages the upper face of the second wall 9 of the tube as appears in FIGS. 21 and 22. And as the tube moves forward relative to the tab, or, stated conversely, as the tab shifts back relative to the tube, the tab is brought to the trailing corner of the tube at the tab end of the tube between the second wall 9 of the tube and the lower half 21 of the gusset 15 at the trailing side Te of the tube, facing the second wall, with the trailing edge 5*t* of the tab in engagement on the inside of the tube with the fold 27 joining the second wall 9 and said gusset half 21 (see FIG. 23).

Figure 23:
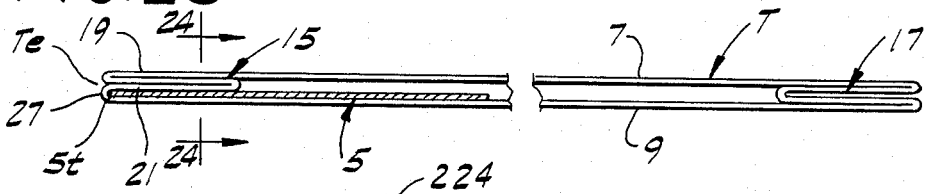
FIG. 23 is a view similar to FIG. 21 showing the final step of the tab insertion procedure involving the flattening of the bag tube and the disposition of the tab between the walls of the flattened bag tube.
Figure 20:
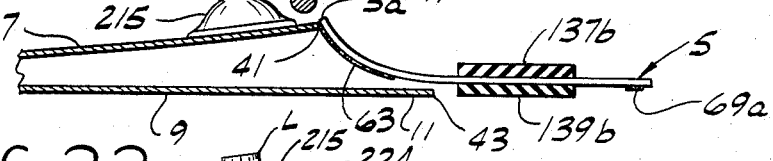
FIG. 20 is a view generally on line 20—20 of FIG. 19 showing how the tab bends up on opening the bag tube in the FIG. 19 step.
Figure 24:
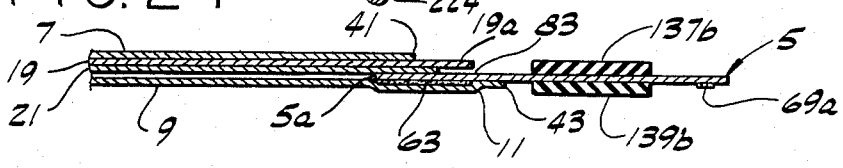
FIG. 24 is a view generally on line 24—24 of FIG. 23 showing the bag tube flattened and the tab as finally inserted.

The means 213 for separating the first wall 7 of the tube T from the second wall 9 is a vacuum grip means comprising a pair of vacuum grippers (suction cups) 215 on a head 217 carried by a pair of crank arms 219 on a pair of shafts 221 continuously driven via a drive 223 from the main drive shaft 157. The grippers 215 are interconnected by means of a flexible vacuum line indicated at L in FIGS. 20 and 22 to a source of vacuum (not shown), and are continuously vacuumized. The head 217, oscillating continuously counterclockwise as viewed in FIG. 12, swings back and down to cause the vacuum grippers 215 to engage and grip the first (upper) wall 7 of the tube T being fed forward under the head, and then swings up and forward to raise wall 7 away from wall 9 as illustrated in FIGS. 20 and 22. Wall 7 is raised to the point where it engages a stripper bar 224 (see FIGS. 15, 18, 20, 22 and 24) which holds wall 7 down to allow the vacuum grippers 215 to break away (disengage) from wall 7, the vacuum grip being low enough for this purpose. Having broken away from wall 7, the vacuum grippers swing back and down to repeat the cycle on the next tube T travelling forward. During the initial phase of the forward swing of the head 217 and grippers 215, their motion is generally in time with the forward motion of the tube T so as to maintain the vacuum grip of the grippers 215 on the tube wall 7. Then, as the tube continues to move forward at tube speed, and the forward component of the motion of the head decreases, wall 7 of the tube is released from the grippers 215 and the tube continues uninterruptedly on in its forward travel. The wall 7 of the tube, upon release from the grippers, comes back down upon the wall 9 and the gusset 15 collapses (flattens out), but by this time the tab 5 is in its final position sandwiched in between the lower gusset half 21 and the second (lower) wall 9 of the tube with the trailing edge 5*t* of the tab engaging the inside of the fold 27 of the tube, as illustrated in FIGS. 23 and 24.

The adhesive at 63 holds the tab 5 to the tube T as the tube continues to travel forward with the tab inserted in the tube, and the tab exits from the tab feed belts 137, 139. Then, the tube T with the inserted tab passes through a tab pressing station S2 (FIGS. 11, 12) where pressure means 225 presses the intermediate portion 83 of the tab against the upper face of extension 11 of the second wall 9 of the tube to insure good adhesion of the tab to the extension. Presser means 225 comprises an upper endless belt 227 and a lower endless belt 229, the upper belt having a lower horizontal forwardly moving reach 227*a* and the lower belt having an upper horizontal forwardly moving reach 229*a* mating with 227*a*, arranged to press portion 83 of the tab which overlies extension 11 down on the upper face of the extension. These belts are driven in timed relation to the tube conveyor 101 via a drive from the main drive shaft 157 indicated generally at 231.

The tube T with the tab 5 inserted therein, adhered at 63 to the upper face of extension 11 of the wall 9 of the tube and pressed against it, exits from the pressing means 225, and then passes through a tab folding station S3 where the outer part 5*b* of the tab projecting out beyond the end edge 43 of the extension 11 engages means indicated at 233 in FIGS. 12 and 15 for folding part 5*b* of the tab over on the fold line 67, i.e., on score line 67, adjacent edge 43 to overlie the outside face (here the bottom face) of wall 9, and is adhered to the outside (bottom) face of wall 9 by the adhesive at 69*a*, *b*. This folding means 233 comprises a plough shaped and positioned first to fold down the outer part 5*b* of the tab around edge 43 of the wall 9, and then to fold it back under wall 9 and press it against the bottom face of wall 9. At this stage of operations, the tab end of the tube and the tab are in the condition illustrated in FIG. 7 except that the tube is horizontal, with wall 7 up and wall 9 down, and that the adhesive 75 for forming the pinch closure has not yet been applied.

The field end holding conveyor 114 terminates as indicated at 114*a* in FIG. 15 just downstream from station S3. The tube T, with tab 5 folded around edge 43 of wall 9 and adhered at 69*a*, *b* to the outside (bottom) face of wall 9, exits from plough 233, is released from conveyor 114, and passes through a registration station S4 where it is registered by means of driven rolls 235 against a moving conveyor stop 237 comprising a plurality of series of lugs 239 on an endless chain 241 at the right of table 103 driven along with chains 107. The rolls 235 are arranged to shift the tube T to the right with respect to table 103 to engage the edge 43 of the tube against the lugs 239, thereby to register the tube for the bottoming operation to follow. The series of lugs 239 are of such length and spaced lengthwise of the chain 241 with gaps such as indicated at 243 therebetween and are so phased relative to the lugs 109 on chains 107 as to allow the tabs 5 to pass on by through station S4 without engaging the lugs 239. This accommodates for differences in extension of the tabs beyond edge 43 of the tubes such as may occur on account of tubes T being of somewhat different length, some variation in tube lengths being customary.

As the tube exits from the registration station S4, it travels through a creasing station S5 (see FIGS. 25 and 26) where means indicated generally at 245 forms a crease at 65 in the tube extending from one side of the tube to the other just inward of the tab end edge of the outer ply 59 of wall 7 of the tube, this crease being for the folding over at 65 of closure flap 73. The creasing means 245 generally comprises upper and lower mating creasing bars 247 and 249 each carried by a pair of crank arms 251, oscillating counterclockwise as viewed in FIG. 25 in timed relation to the passage of the tubes T. One bar has a creasing tongue and the other a groove. As the bars swing back, they come together to crease the tube at 65, and then they swing up and return. The creasing bars are generally conventional and their detail is not critical so far as this invention is concerned.

As the tube exits from the creasing station S5, it travels through an adhesive applying station S6 (see FIGS. 25 and 26) where a hot melt adhesive applicator indicated generally at 253 applies the adhesive stripe 75 for gluing down the flap 73 to be folded over to form the pinch closure at the tab or factory end of the tube T. This applicator is generally conventional and its detail is not critical so far as this invention is concerned.

As the tube exits from the adhesive applying station S6, it travels through a pinch closure folding station S7 (FIGS. 27 and 28) where a plough 255 folds the end portion of the tube between the crease 65 and the edge 43 of wall 9 of the tube, i.e., the closure flap portion 73 of the tube, up on the crease 65 and over and down, said closure flap portion 73 becoming adhered by the adhesive at 75 to the outside (upper) face of wall 7 of the tube.

Finally, the tube exits from the folding station S7, it passes through a closure presser station S8 where the closure flap 73 is pressed down on wall 7 for good adhesion of presser means 257 comprising upper and lower presser belts 259 and 261. This is generally conventional and the detail is not critical so far as this invention is concerned.

In the operation of the apparatus, carrying out the method of this invention, bag tubes T are continuously fed forward one after another in their stated horizontal path of travel on table 103 of the tube conveyor means with the tubes extending transversely with respect to said path of travel, with wall 7 up and wall 9 down. The tab feed means 115 functions to deliver a tab 5 for each tube to the tab insertion station S1 for applying the tab to the tube as the tube is fed forward by the conveyor means 101 with the inner end margin of the tab at 5*a* overlapping the wall 7, an intermediate part of the tab overlying the portion of the inside face 9*a* of wall 9 included in extension 11, and outer part 5*b* of the tab extending out beyond the end edge 43 of extension 11 the distance X greater then the spacing Y of line 65 from edge 43. The inner end margin of the tab at 5*a* of the tab is inserted between the walls 7 and 9 at station S1 by the action of vacuum grippers 215 raising wall 7 of the tube while belts 137 and 139 hold the outer part of the tab from bending up so that the inner part of the tab bends outwardly (up) away from extension 11, wall 7 being raised to a point where the inner end margin of the tab at 5*a* slips down off wall 7 and becomes disposed between walls 7 and 9. As the tube T continues its forward travel, the inserted tab slips back against the inside of fold 27 between wall 9 and the bottom half 21 of gusset 15 (see FIGS. 4 and 24). The adhesive applied at 63 to the tab glues the tab to the tube, and the tab is pressed down by means 225 at station S2 for good adhesion of the tab to the tube (i.e., to the upper face of extension 11 of the tube). At station S3, the outer part 5*b* of the tab is folded by plough 233 on fold line 67 adjacent edge 43 of extension 11 to overlie the outside face 9*b* of wall 9, this part 5*b* becoming releasably adhered to the outside face 9*b* of wall 9 by the adhesive at 69*a* and 69*b* with the outer end 5*c* of the tab adapted to be grasped and pulled away from wall 9. At station S4 the tube is registered; at station S5 the tube is creased at 65; at station S6 adhesive 75 is applied; and at station S7 flap 73 is folded over on line 65 to overlie the outside face 7*b* of wall 7 of the tube and to become adhered thereto to form the pinch closure. At station S8 the flap 73 is pressed for good adhesion, completing the bag B. When the flap 73 is folded over at station S7, part 5*b* of the tab is folded on line 65 ending up with portion 83 on the inside of flap 73 adhered along with the flap 73 by the adhesive at 75 to the outside face 7*b* of wall 7, with portion 85 on the outside of the flap 73 and free of the flap, and with portion 89 on the outside of wall 9 releasably adhered at 69*a, b* to wall 9 and adapted to be torn away from wall 9 and pulled to tear the bag open at the pinch closure.

In view of the above, it will be seen that the several objects of the invention are achieved and other advantageous results attained.

As various changes could be made in the above methods and constructions without departing from the scope of the invention, it is intended that all matter contained in the above description or shown in the accompanying drawings shall be interpreted as illustrative and not in a limiting sense.

What is claimed is:

1. A bag having a pinch closure at one end and a tab for opening it at said end, the bag being formed from a bag tube having first and second walls, the second wall having an extension beyond the first at said end, the closure comprising a flap constituted by an end portion of the tube at said end folded over on a fold line spaced inwardly from the end edge of the first wall at said end, said flap thereby comprising the end portion of the first wall from said fold line to said end edge of the first wall, a portion of the second wall coextensive with said end portion of the first wall and said extension of the second wall, the tab having an inner end portion between said portions of the walls, an intermediate portion underneath said extension, and an outer portion projecting out from under said extension, said flap being adhered to the outside face of the first wall, the intermediate portion of the tab being adhered to the outside face of the first wall, characterized in that the outer portion of the tab has a first part folded over on a fold line adjacent the end edge of the second wall at said end of the bag overlying said flap and a second part folded over on a fold line generally coincident with the first-mentioned fold line and overlying the second wall of the bag, said second part being releasably adhered to said second wall of the bag and having a free portion enabling it to be grasped and pulled to tear the bag open.

2. A bag as set forth in claim 1 wherein the tab is adjacent one side of the bag at said end.

3. A bag as set forth in claim 1 wherein the said first part of the outer portion of the tab is free of said flap.

4. A bag as set forth in claim 3 wherein the tab is adjacent one side of the bag at said end.

5. A bag having a pinch closure at one end and a tab for opening it at said end, the bag being formed from a bag tube having first and second walls, the second wall having an extension beyond the first at said end, the closure comprising a flap constituted by an end portion of the tube at said end folded over on a fold line spaced inwardly from the end edge of the first wall at said end, said flap thereby comprising the end portion of the first wall from said fold line to said end edge of the first wall, a portion of the second wall coextensive with said end portion of the first wall and said extension of the second wall, the tab having an inner end portion between said portions of the walls, an intermediate portion underneath said extension, and an outer portion projecting out from under said extension, said flap being adhered to the outside face of the first wall, the intermediate portion of the tab being adhered to the outside face of the first wall, characterized in that the outer portion of the tab has a first part folded over on a fold line adjacent the end edge of the second wall at said end of the bag overlying said flap and a second part folded over on a fold line generally coincident with the first-mentioned fold line and overlying the second wall of the bag, said second part being releasably adhered to said second wall of the bag and having a free portion enabling it to be grasped and pulled to tear the bag open, the tab being adjacent one side of the bag at said end, the bag having gussets at its sides, each gusset having a first half toward the first wall and a second half toward the second wall, said tab lying between the second half of the gusset at said one side of the bag and said second wall of the bag.

6. A bag as set forth in claim 5 wherein the gussets have end portions extending beyond the end of said first wall at said one end of the bag and terminating short of the said extension of said second wall, the first half of the gusset being stepped beyond the second half of the gusset at said one side of the bag.

7. A bag having a pinch closure at one end a tab for opening it at said end, the bag being formed from a bag tube having first and second walls, the second wall having an extension beyond the first at said end, the closure comprising a flap constituted by an end portion of the tube at said end folded over on a fold line spaced inwardly from the end edge of the first wall at said end, said flap thereby comprising the end portion of the first wall from said fold line to said end edge of the first wall, a portion of the second wall coextensive with said end portion of the first wall and said extension of the second wall, the tab having an inner end portion between said portions of the walls, an intermediate portion underneath said extension, and an outer portion projecting out from under said extension, said flap being adhered to the outside face of the first wall, the intermediate portion of the tab being adhered to the outside face of the first wall, characterized in that the outer portion of the tab has a first part folded over on a fold line adjacent the end edge of the second wall at said end of the bag overlying said flap and a second part folded over on a fold line generally coincident with the first-mentioned fold line and overlying the second wall of the bag, said second part being releasably adhered to said second wall of the bag and having a free portion enabling it to be grasped and pulled to tear the bag open, the said first part of the outer portion of the tab being free of said flap, the tab being adjacent one side of the bag at said end, the bag having gussets at its sides, each gusset having a first half toward the first wall and a second half toward the second wall, said tab lying between the second half of the gusset at said one side of the bag and said second wall of the bag.

8. A bag as set forth in claim 7 wherein the gussets have end portions extending beyond the end of said first wall at said one end of the bag and terminating short of the said extension of said second wall, the first half of the gusset being stepped beyond the second half of the gusset at said one side of the bag.

9. The method of making a bag with a pinch closure at one end and a tab for opening it at the closure from a bag tube having first and second walls with an extension of the second wall beyond the first at said one end of the tube, each wall having an inside face and an outside face, an end portion of the tube at its said one end being adapted to be folded over on the first wall of the tube on a first fold line spaced inwardly from the end edge of said first wall at said one end of the tube to form a closure flap, said method comprising:

applying a tab to the tube at its said one end with part of the tab on the portion of the inside face of the second wall included in said extension and an outer part of the tab extending out beyond the end edge of said extension a distance greater than the spacing of said first fold line from the end edge of said extension, and adhering the tab to said extension;

folding said outer part of the tab over on a second fold line adjacent said end edge of the extension to overlie the outside face of said second wall, and releasably adhering said outer part of the tab to the outside face of said second wall with the outer end of the tab adapted to be grasped and pulled away from the second wall; and folding said closure flap over on said first fold line to overlie said first wall of the tube and adhering it thereto to form a pinch closure at said one end of the tube, that part of the tab between said first and second fold lines folding over with the flap and being adhered along with the flap to said first wall, said outer part of the tab being folded on said first fold line as the flap is folded over and ending up with a portion on the outside of the flap and a portion on the outside of the second wall releasably adhered to the second wall and adapted to be torn away from the second wall and pulled to tear the bag open at the closure.

10. The method of claim 9 wherein, in applying the tab to the tube, the inner end of the tab is inserted between the tube walls.

11. The method of claim 10 wherein the inner end margin of the tab is inserted between the tube walls by bringing the tab into a position for insertion at said one end of the tube with the inner end margin of the tab overlapping the first wall of the tube and then separating the first wall of the tube from the second wall while holding the outer part of the tab so that the inner end margin of the tab bends outwardly, the first wall being separated from the second wall to a point where the inner end margin of the tab slips off the first wall and becomes disposed between the walls.

12. The method of claim 11 wherein the tab is initially applied to the tube spaced from a side edge of the tube, and, following insertion, is brought against said side edge.

13. The method of claim 12 wherein the tube has gussets at its sides and the tab is brought between the second wall of the tube and that half of the gusset at said side edge facing the second wall and into engagement with the fold joining the second wall and said gusset half.

* * * * *